United States Patent [19]

Grady

[11] Patent Number: 5,022,524

[45] Date of Patent: Jun. 11, 1991

[54] LIGHT-TIGHT PACKAGE

[75] Inventor: Ralph E. Grady, Loveland, Colo.

[73] Assignee: Eastman Kodak Company, Rochester, N.Y.

[21] Appl. No.: 552,644

[22] Filed: Jul. 16, 1990

[51] Int. Cl.[5] ..... B65D 81/30

[52] U.S. Cl. ..... 206/395; 242/71.7; 354/275

[58] Field of Search ..... 206/389, 395, 396, 397, 206/408, 409, 455, 456, 601; 229/23 BT, 23 R; 242/71.1, 71.7; 354/275

[56] References Cited

U.S. PATENT DOCUMENTS

| | | | |
|---|---|---|---|
| 2,321,145 | 6/1943 | Jones | 229/152 |
| 2,942,768 | 6/1960 | McCall | 229/152 |
| 2,990,095 | 6/1961 | Torre et al. | 206/389 |
| 3,014,633 | 12/1961 | Tarmina | 229/179 |
| 3,084,882 | 4/1963 | Riley et al. | 242/71.1 |
| 3,194,475 | 7/1965 | Ralston | 229/153 |
| 3,226,007 | 12/1965 | Thies et al. | 229/153 |
| 3,269,638 | 8/1966 | Forbes | 229/178 |
| 4,027,794 | 6/1977 | Olson | 206/395 |
| 4,034,891 | 7/1977 | Mecham | 220/339 |
| 4,295,599 | 10/1981 | Locatelli et al. | 229/34 R |
| 4,431,139 | 2/1984 | Barnsbee | 206/409 |
| 4,552,268 | 11/1985 | Lee | 206/459 |
| 4,570,845 | 2/1986 | Hall | 229/33 |

FOREIGN PATENT DOCUMENTS

| | | | |
|---|---|---|---|
| 1278141 | 10/1961 | France | 229/23 BT |

*Primary Examiner*—Jimmy G. Foster
*Attorney, Agent, or Firm*—William C. Dixon, III

[57] ABSTRACT

A light-tight package, for securely containing a light-sensitive article, comprises a mating pair of rectanguloid inner and outer boxes. The inner box, adapted to enclose the light-sensitive article, has a bottom wall, front and rear walls, opposite end walls, and a closable and openable top wall with an integral flap that tucks inside the front wall. The outer box, adapted to enclose the inner box, has a top wall, front and rear walls, and opposite end walls, but no bottom wall. The walls of both boxes are formed by selective folding of specially configured paperboard blanks. The resulting inner and outer box is closed with its top wall facing upward, and the outer box is superposed thereover with its top wall also facing upward, the outer box is slidable downward in snug telescoping fashion around the inner box, with corresponding front, rear, and opposite end walls of the two boxes disposed in close confronting relation to one another, thereby providing a durable light-tight package for a light-sensitive article enclosed within the inner box.

5 Claims, 6 Drawing Sheets

FIG. 12
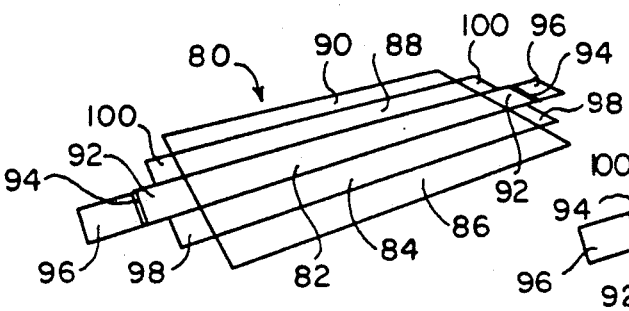
FIG. 13
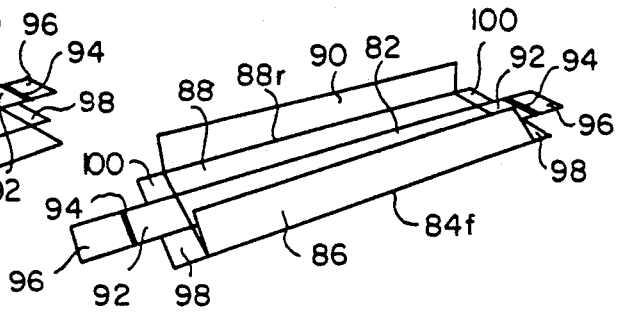
FIG. 14
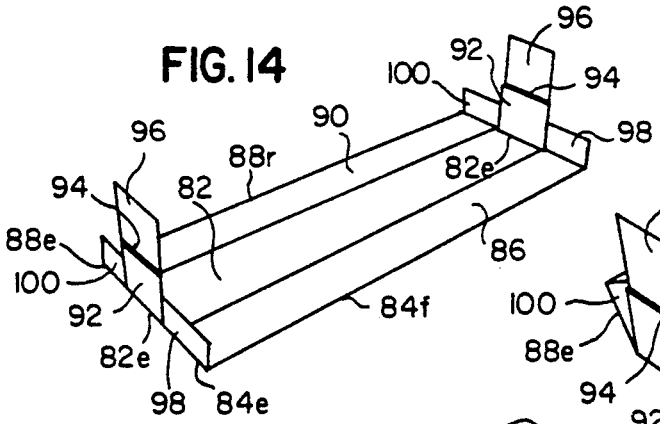
FIG. 15
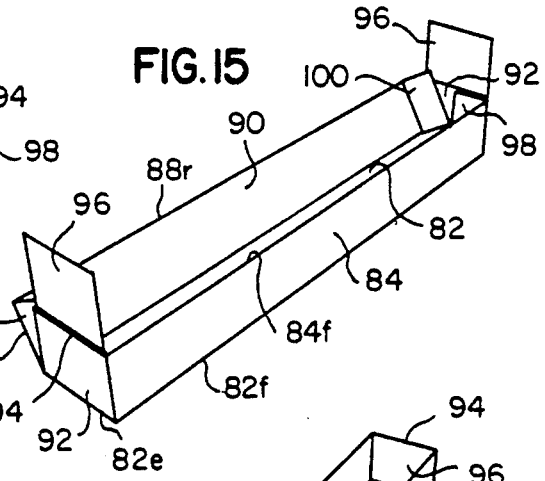
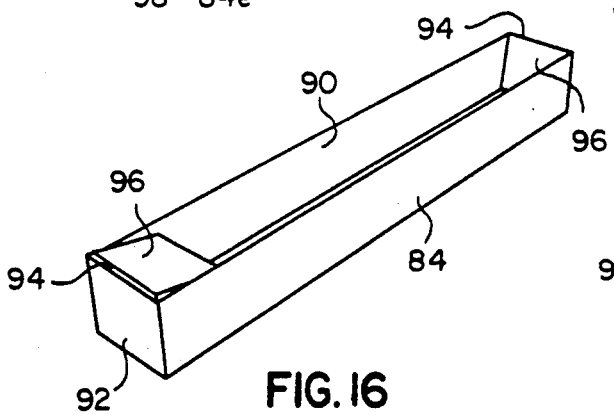
FIG. 16
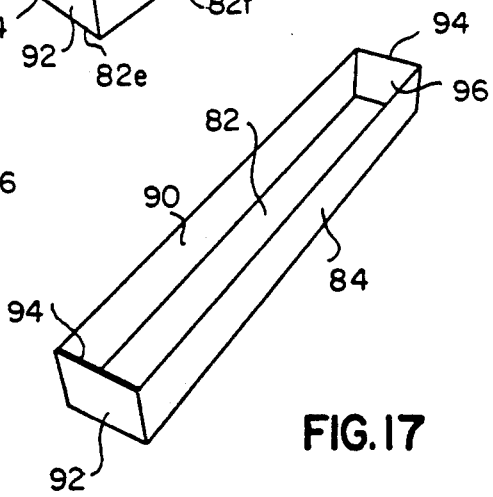
FIG. 17

LIGHT-TIGHT PACKAGE

BACKGROUND OF THE INVENTION

1. Field of the Invention

The present invention relates generally to packaging, and particularly to a packaging arrangement for securely containing one or more light-sensitive articles in a light-tight environment.

2. Description of the Prior Art

Packaging arrangements for containing various types of articles are well known in the prior art. Examples may be found in the following patents:

U.S. Pat. No. 2,942,768 (McCall)—discloses a rectanguloid box made from a single blank of cardboard folded to form a box body and a foldable lid, the lid comprising a top-wall section whose opposite ends overhang the body end walls and a narrower, foldably depending tucker section that closely faces the inside surface of the body front wall and whose opposite ends lie close to the end walls, each end wall comprising outer, intermediate, and inner end-wall panels, the outer end-wall panel having an inwardly folded extension thereof that passes beneath the intermediate and inner end-wall panels toward the body interior and overlies the bottom wall.

U.S Pat. No. 3,269,638 (Forbes)—discloses a rectanguloid box made from a single blank of cardboard folded to form a box body and a foldable lid, the lid comprising a top-wall panel whose opposite ends overhang the body end walls and a narrower, foldably depending tucker panel that closely faces the inside surface of the body front wall and whose opposite ends lie close to the inside surfaces of the body end walls, each end wall comprising outer, intermediate, and inner end-wall panels, each outer end-wall panel having an inwardly folded bottom panel that extends therefrom beneath the adjacent intermediate and inner end-wall panels, toward the body center, and overlies the body bottom wall.

U.S. Pat. No. 4,295,599 (Locatelli et al.)—discloses a rectanguloid box made from a single blank of cardboard folded to form a box body and a foldable lid, the lid comprising a top cover panel, whose opposite ends overhang opposing body end walls, and a narrower, beveled, foldably depending flap panel that frictionally bears against the inside surface of the body front wall, and whose opposite ends frictionally bear against the inside surfaces of the body end walls, to effect a seal between the cover panel and the front wall and to keep the cover panel closed, each of the body end walls comprising an inverted-U-shaped continuum of outer, upper, and inner end-wall panels extending from and secured to the adjacent end of the body bottom wall.

U.S. Pat. No. 4,027,794 (Olson)—discloses a rectanguloid container for shipping a cylindrical object having an axially disposed core, the container comprising a rectanguloid inner box including complemental base and cover sections that enclose the object and a mating outer box that is bottomless and telescopes downward over the inner box.

While prior-art arrangements such as those described above may have sufficed for their own particular purposes, there has remained, nonetheless, a need for an improved packaging arrangement that is especially adapted to light-tightly secure a light-sensitive article, such as a photosensitive web roll, especially such a roll that is of relatively large size, without requiring a separate opaque wrapper around the light-sensitive article itself.

An overall object of this invention, therefore, has been to provide a packaging arrangement that meets the foregoing need, and to do so in an efficient, reliable, and convenient manner.

SUMMARY OF THE INVENTION

In accordance with that object, and as shown and described herein, the present invention finds utility in a light-tight package for securely containing a light-sensitive article, the package comprising:

- a closable and openable rectanguloid inner box that is adapted to enclose the light-sensitive article, the inner box having a bottom wall, front and rear walls, opposite end walls, and, when closed, a top wall, the inner-box walls being formed from a first sheet of corrugated paperboard that includes:
  - a rectangular bottom-wall panel defined by longitudinal front and rear score lines and transverse opposite end score lines;
  - a rectangular front-wall outer panel defined by the bottom-wall-panel front score line, a longitudinal front-wall score line, and transverse opposite end score lines;
  - a front-wall inner panel defined by the front-wall score line, a longitudinal front-wall edge, and transverse opposite end edges;
  - a rectangular rear-wall panel defined by the bottom-wall-panel rear score line, a longitudinal rear-wall score line, and transverse opposite end score lines;
  - rectangular opposite-end-wall outer panels defined by the bottom-wall-panel opposite end score lines respectively, transverse opposite-end-wall outer-panel score lines respectively, and longitudinal opposite-end-wall outer-panel front and rear edges;
  - opposite-end-wall top panels defined by the opposite-end-wall outer-panel score lines respectively, transverse opposite-end-wall top-panel score lines respectively, and opposite-end-wall top-panel front and rear edges;
  - opposite-end-wall inner panels defined by the opposite-end-wall top-panel score lines respectively, transverse opposite-end-wall inner-panel score lines respectively, and longitudinal opposite-end-wall inner-panel front and rear edges;
  - opposite-end-wall inner-panel end flaps defined by the opposite-end-wall inner-panel score lines respectively, transverse opposite end-flap end edges respectively, and substantially longitudinal opposite end-flap front and rear edges;
  - opposite-end-wall intermediate front partial panels defined by the front-wall outer-panel opposite end score lines respectively, transverse opposite front-partial-panel end edges respectively, and longitudinal opposite front-partial-panel bottom and top edges;
  - opposite-end-wall intermediate rear partial panels defined by the rear-wall-panel opposite end score lines respectively, transverse opposite rear-partial-panel end edges respectively, and longitudinal opposite rear-partial-panel bottom and top edges;

a rectangular top-wall lid panel defined by the rear-wall score line, a longitudinal top-wall-lid score line, and transverse opposite end edges;

a substantially rectangular top-wall tucker panel defined by the top-wall-lid score line, a longitudinal top-wall-tucker score line, and transverse opposite end edges; and a top-wall tucker-flap panel defined by the top-wall-tucker score line, a longitudinal top-wall-tucker edge, and opposite end edges;

the bottom-wall panel as defined by the front and rear score lines and the opposite end score lines thereof forming the inner-box bottom wall;

the front-wall outer and inner panels being folded about the bottom-wall-panel front score line and the front-wall score line, respectively, into adjacent confronting relation with each other to form the inner-box front wall;

the rear-wall panel being folded about the bottom-wall-panel rear score line into spaced confronting relation with the folded front-wall inner panel to form the inner-box rear wall;

the opposite-end-wall intermediate front partial panels being folded about the front-wall outer-panel opposite end score lines, respectively, into spaced confronting relation with each other;

the opposite-end-wall intermediate rear partial panels being folded about the rear-wall-panel opposite end score lines, respectively, into spaced confronting relation with each other;

the opposite-end-wall outer panels being folded about the bottom-wall-panel opposite end score lines, respectively, into adjacent confronting relation with the folded opposite-end-wall intermediate front and rear partial panels;

the opposite-end-wall top panels being folded about the opposite-end-wall outer-panel score lines, respectively, into adjacent confronting relation with the folded opposite-end-wall intermediate front- and rear-partial-panel top edges;

the opposite-end-wall inner panels being folded about the opposite-end-wall top-panel score lines, respectively, into adjacent confronting relation with the folded opposite-end-wall intermediate front and rear partial panels;

the opposite-end-wall inner-panel end flaps being folded about the opposite-end-wall inner-panel score lines, respectively, into adjacent confronting relation with opposite end portions of the bottom-wall panel respectively;

the opposite-end-wall outer, intermediate, inner, and top panels, so folded, together forming the inner-box opposite end walls respectively; and the top-wall lid panel being folded about the rear-wall score line, the top-wall tucker panel being folded about the top-wall-lid score line, and the top-wall tucker-flap panel being bent about the top-wall-tucker score line, so as to place opposite end portions of the top-wall lid panel into adjacent confronting relation with the folded opposite-end-wall top panels, respectively, and the top-wall tucker and tucker-flap panels into adjacent confronting relation with the folded front-wall inner panel, to thereby form the inner-box top wall and close the inner box; and a bottomless rectanguloid outer box adapted to enclose the inner box, the outer box having a top wall, front and rear walls, and opposite end walls, the outer-box walls being formed from a second sheet of corrugated paperboard that includes:

a rectangular top-wall section defined by longitudinal front and rear score lines and transverse opposite end score lines;

a rectangular front-wall outer section defined by the top-wall-section front score line, a longitudinal front-wall score line, and transverse opposite end score lines;

a front-wall inner section defined by the front-wall score line, a longitudinal front-wall edge, and transverse opposite end edges;

a rectangular rear-wall outer section defined by the top-wall-section rear score line, a longitudinal rear-wall score line, and transverse opposite end score lines;

a rear-wall inner section defined by the rear-wall score line, a longitudinal rear-wall edge, and transverse opposite end edges;

rectangular opposite-end-wall outer sections defined by the top-wall-section opposite end score lines respectively, transverse opposite-end-wall outer-section score lines respectively, and longitudinal opposite-end-wall outer-section front and rear edges;

opposite-end-wall bottom sections defined by the opposite-end-wall outer-section score lines respectively, transverse opposite-end-wall bottom-section score lines respectively, and opposite-end-wall bottom-section front and rear edges;

opposite-end-wall inner sections defined by the opposite-end-wall bottom-section score lines respectively, transverse opposite-end-wall inner-section end edges respectively, and longitudinal opposite-end-wall inner-section front and rear edges;

opposite-end-wall intermediate front partial sections defined by the front-wall outer-section opposite end score lines respectively, transverse opposite front-partial-section end edges respectively, and longitudinal opposite front-partial-section top and bottom edges;

opposite-end-wall intermediate rear partial sections defined by the rear-wall outer-section opposite end score lines respectively, transverse opposite rear-partial-section end edges respectively, and longitudinal opposite rear-partial-section top and bottom edges;

the top-wall section as defined by the front and rear score lines and the opposite end score lines thereof forming the outer-box top wall;

the front-wall outer and inner sections being folded about the top-wall-section front score line and the front-wall score line, respectively, into adjacent confronting relation with each other to form the outer-box front wall;

the rear-wall outer and inner sections being folded about the top-wall-section rear score line and the rear-wall score line, respectively, into adjacent confronting relation with each other to form the outer-box rear wall in spaced confronting relation with the outer-box front wall;

the opposite-end-wall intermediate front partial sections being folded about the front-wall outer-section opposite end score lines, respectively, into spaced confronting relation with each other;

the opposite-end-wall intermediate rear partial sections being folded about the rear-wall outer-section opposite end score lines, respectively, into spaced confronting relation with each other;

the opposite-end-wall outer sections being folded about the top-wall-section opposite end score lines, respectively, into adjacent confronting relation with the folded opposite-end-wall intermediate front and rear partial sections;

the opposite-end-wall bottom sections being folded about the opposite-end-wall outer-section score lines, respectively, into adjacent confronting relation with the folded opposite-end-wall intermediate front- and rear-partial-section bottom edges; and the opposite-end-wall inner sections being folded about the opposite-end-wall bottom-section score lines, respectively, into adjacent confronting relation with the folded opposite-end-wall intermediate front and rear partial sections;

the opposite-end-wall outer, intermediate, inner, and bottom sections, so folded, together forming the outer-box opposite end walls respectively;

the inner and outer boxes being configured and dimensioned so that, when the inner box is closed with its top wall facing upward, and the outer box is superposed thereover with its top wall also facing upward, the outer box is slidable downward in telescoping fashion closely around the inner box, with the front and rear walls and the opposite end walls of the two boxes disposed in corresponding adjacent confronting relation to one another, thereby forming the light-tight package for securely containing the light-sensitive article when enclosed within the inner box.

According to the preferred embodiment of this invention, the inner-box opposite-end-wall inner panels include means adjacent to the opposite-end-wall top panels, respectively, for receiving the top-wall tucker-panel opposite end edges, respectively, when the inner-box wall panels are folded to form the inner box and the top-wall tucker and tucker-flap panels are placed into their adjacent confronting relation with the front-wall inner panel to close the inner box. As illustrated herein, said receiving means includes a recess in the front edge of each inner panel which extends from the adjacent top panel toward the inner-panel score line, that recess and an adjacent end portion of the front-wall inner panel together defining a slot for receiving the corresponding tucker-panel end edge.

This invention, and its objects and advantages, will become more apparent in the detailed description of a preferred embodiment thereof presented hereinbelow.

BRIEF DESCRIPTION OF THE DRAWINGS

In the detailed description of the preferred embodiment of this invention set forth below, reference is made to the accompanying drawings, wherein like reference characters denote like elements, and wherein:

FIGS. 12–17 are perspective views showing the paperboard blank of FIG. 11 in successive stages of being folded to form the outer-box component.

DESCRIPTION OF THE PREFERRED EMBODIMENT

Because certain parts of article packaging arrangements are well known, the following description is directed in particular to those elements forming, cooperating directly with, or relating especially to, this invention. Elements not specifically shown or described herein are selectable from those known in the pertinent art.

Figure 1C:
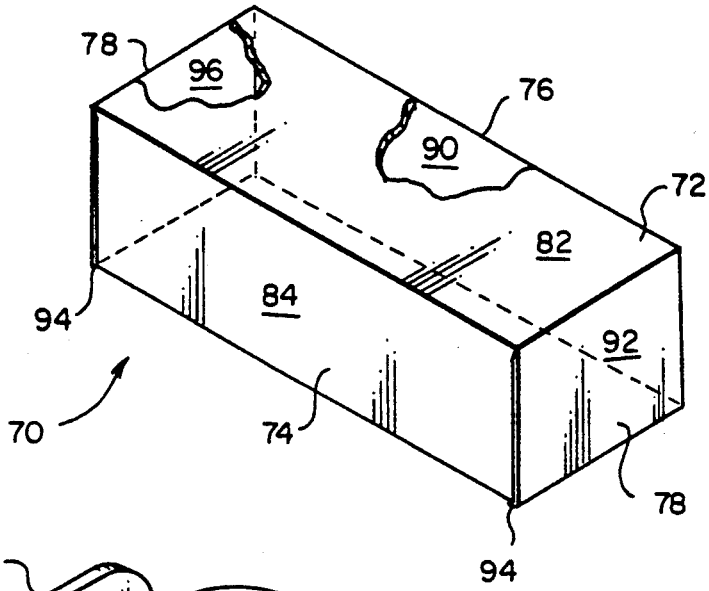
FIGS. 1*a*, 1*b*, and 1*c*, taken together, present an exploded view, in perspective, of a light-tight package constructed according to the preferred embodiment of this invention, FIG. 1*a* showing a light-sensitive article to be securely contained therein, FIGS. 1*b* and 1*c* showing, respectively, inner-box and outer-box components of the package.
Figure 1A:
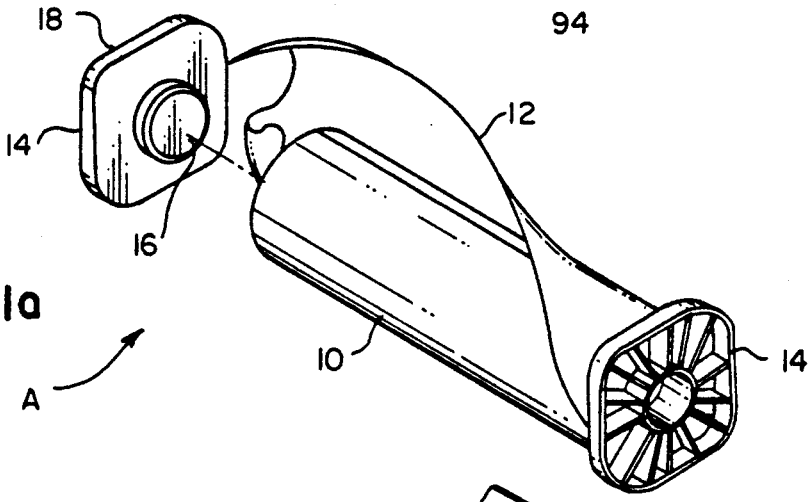

FIG. 1*a* illustrates a light-sensitive article A comprising a photosensitive web roll 10 with an opaque wrapper 12 loosely disposed thereon and a pair of roll-supporting hub members 14 at opposite ends thereof. The web roll consists of an elongate sheet of sensitized web material, such as paper or film, wound upon a hollow cylindical core (not shown). Each of the hub members 14 includes a core-supporting hub portion 16 projecting from one face of a generally square-shaped flange portion 18.

Figure 1B:
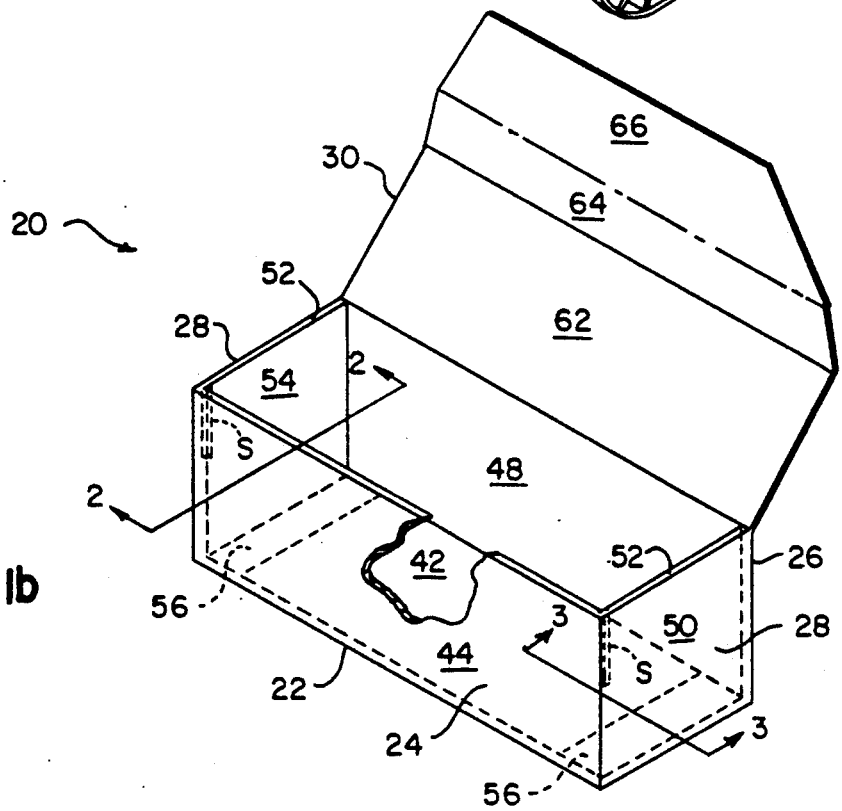
Figure 2:
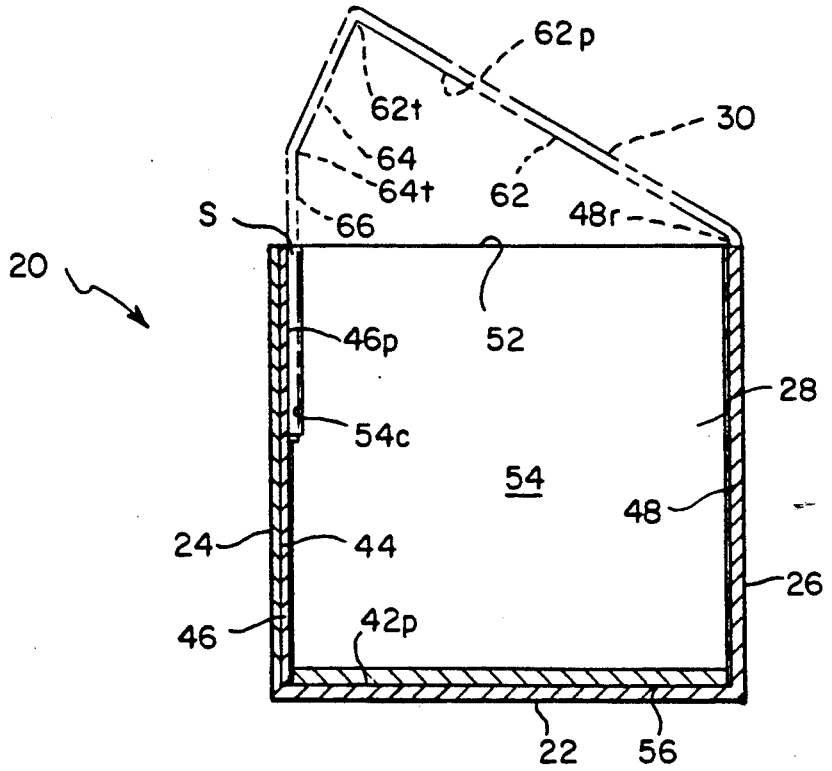
FIGS. 2 and 3 are cross-sectional views, taken respectively along lines 2—2 and 3—3 in FIG. 1, showing details of the inner-box component of the package.
Figure 3:
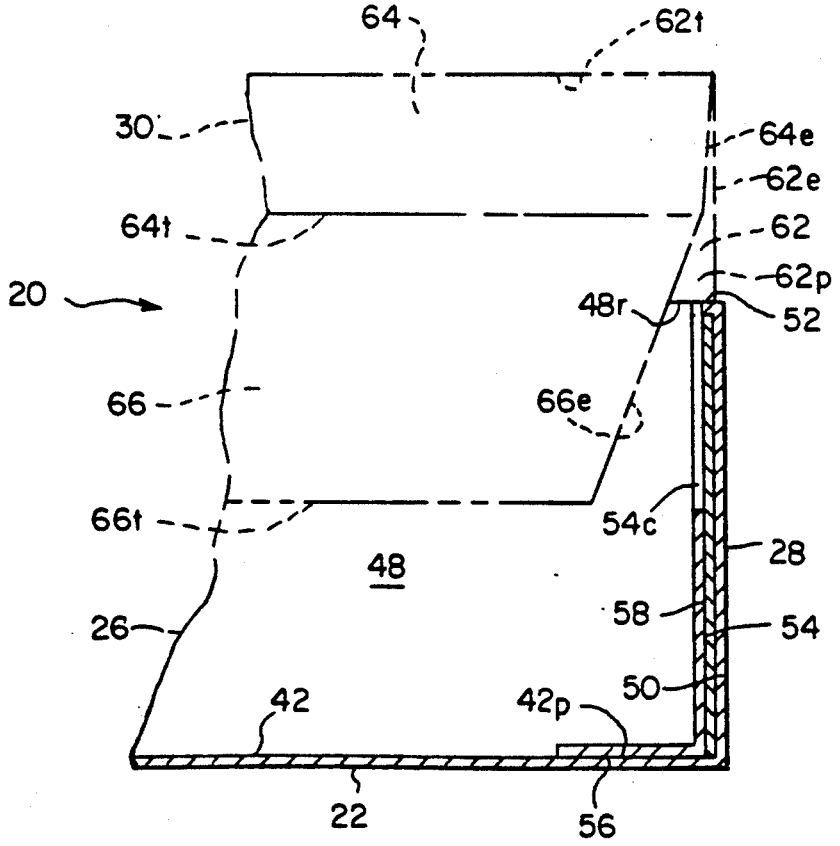

In FIG. 1*b* is shown closable and openable rectanguloid inner box 20 that is adapted to enclose the light-sensitive article A. The inner box 20 has a bottom wall 22, front and rear walls 24 and 26 respectively, opposite end walls 28, and, when closed, a top wall 30.

Figure 4:
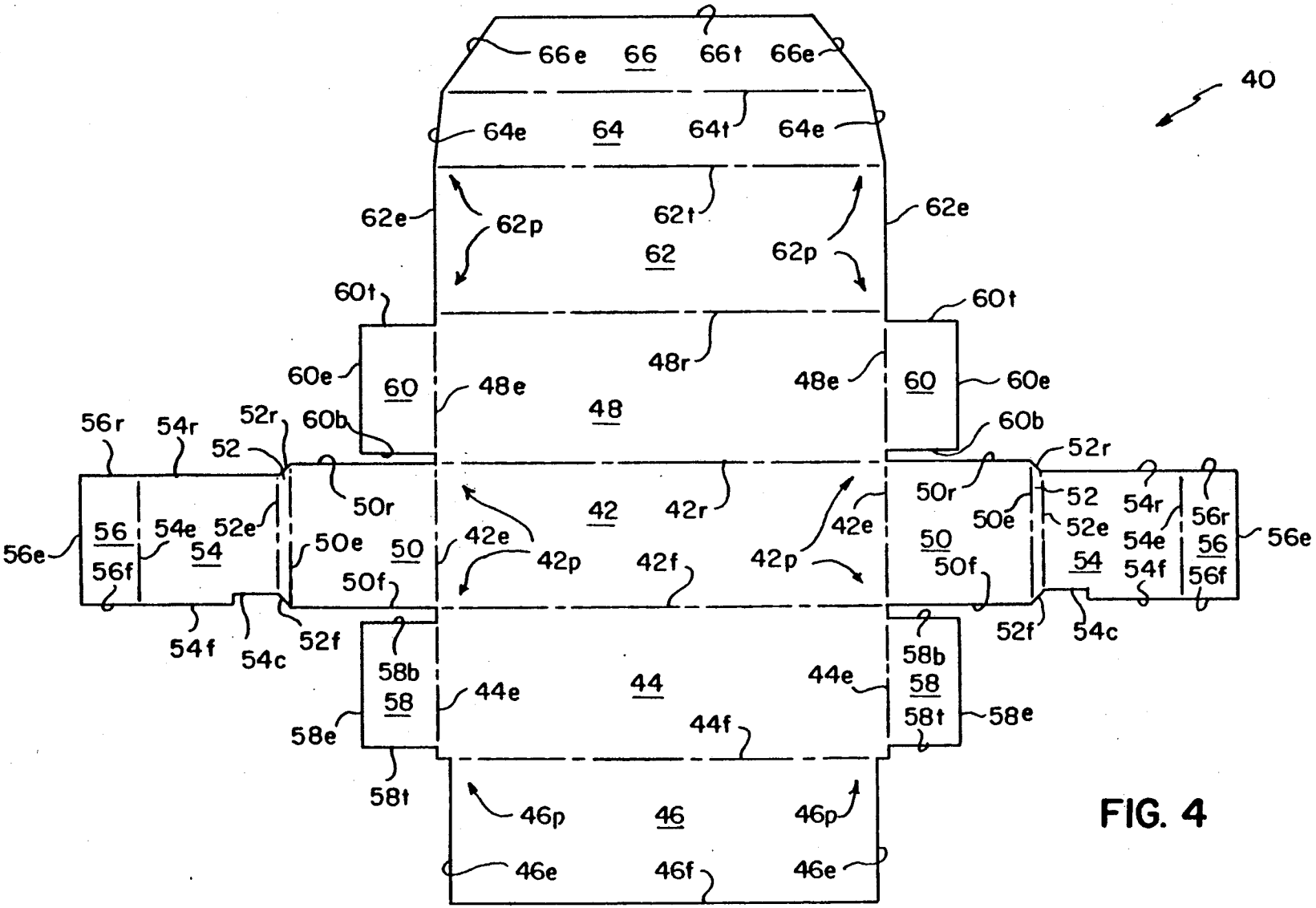
FIG. 4 is a top-plan view of a paperboard blank from which the inner-box component is formed.
Figure 5:
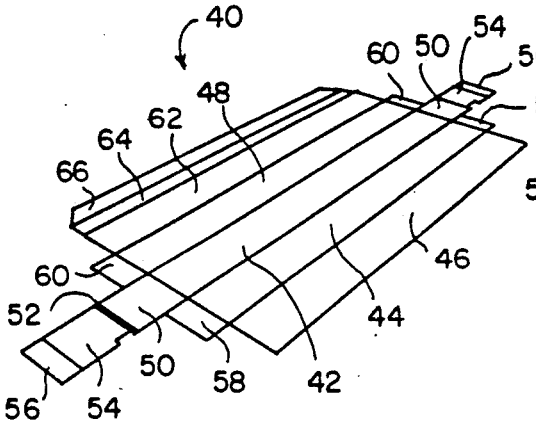
FIGS. 5–10 are perspective views showing the paperboard blank of FIG. 4 in successive stages of being folded to form the inner-box component.
Figure 6:
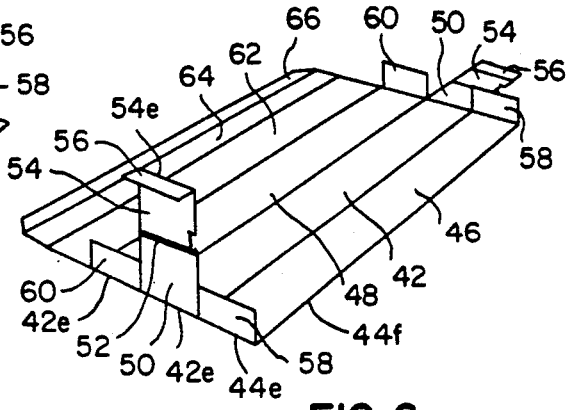
Figure 7:
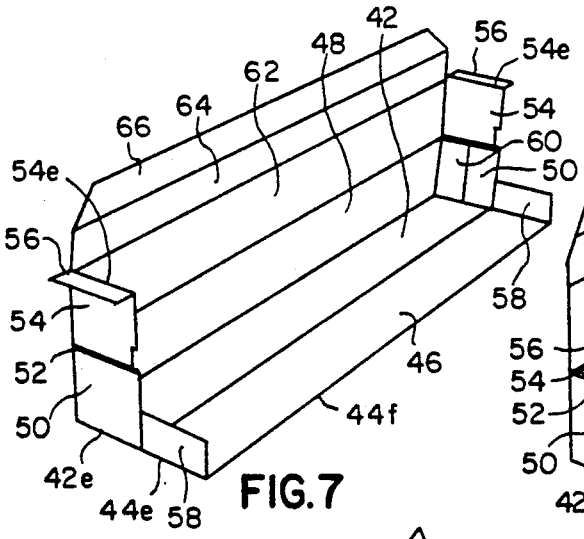
Figure 8:
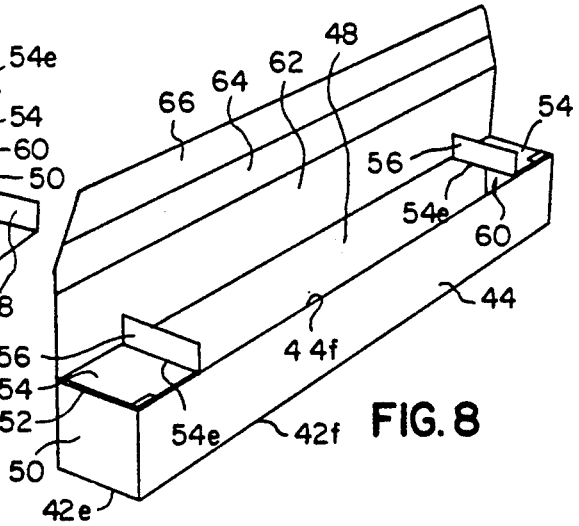
Figure 9:
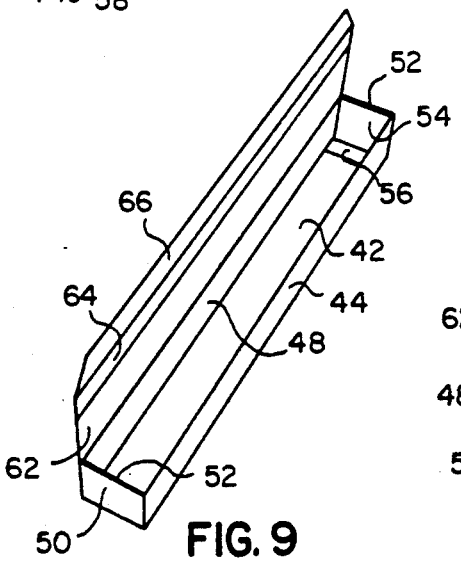
Figure 10:
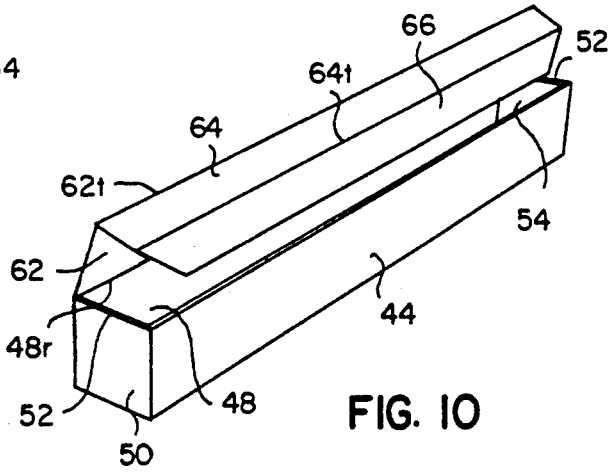

The inner box walls are formed from a corrugated paperboard blank 40, shown in FIG. 4. Blank 40 includes a rectangular bottom-wall panel 42 defined by longitudinal front and rear score lines 42*f* and 42*r* respectively and transverse opposite end score lines 42*e*; a rectangular front-wall outer panel 44 defined by the bottom-wall-panel front score line 42*f*, a longitudinal front-wall score line 44*f*, and transverse opposite end score lines 44*e*; a front-wall inner panel 46 defined by the front-wall score line 44*f*, a longitudinal front-wall edge 46*f*, and transverse opposite end edges 46*e*; a rectangular rear-wall panel 48 defined by the bottom-wall-panel rear score line 42*r*, a longitudinal rear-wall score line 48*r*, and transverse opposite end score lines 48*e*; rectangular opposite-end-wall outer panels 50 defined by the bottom-wall-panel opposite end score lines 42*e* respectively, transverse opposite-end-wall outer-panel score lines 50*e* respectively, and longitudinal opposite-end-wall outer-panel front and rear edges 50*f* and 50*r*; opposite-end-wall top panels 52 defined by the opposite-end-wall outer-panel score lines 50*e* respectively, transverse opposite-end-wall top-panel score lines 52*e* respectively, and opposite-end-wall top-panel front and rear edges 52*f* and 52*r* respectively; opposite-end-wall inner panels 54 defined by the opposite-end-wall top-panel score lines 52*e* respectively, transverse opposite-end-wall inner-panel score lines 54*e* respectively, and longitudinal opposite-end-wall inner-panel front and rear edges 54*f* and 54*r* respectively; opposite-end-wall inner-panel end flaps 56 defined by the opposite-end-wall inner-panel score lines 54*e* respectively, transverse opposite end-flap end edges 56*e* respectively, and substantially longitudinal opposite end-flap front and rear edges 56*f* and 56*r* respectively; opposite-end-wall intermediate front partial panels 58 defined by the front-wall outer-panel opposite end score lines 44*e* respectively, transverse opposite front-partial-panel end edges 58*e* respectively, and longitudinal opposite front-partial-panel bottom and top edges 58*b* and 58*t* respectively; opposite-end-wall intermediate rear partial panels 60 defined by the rear-wall-panel opposite end score lines 48*e* respectively, transverse opposite rear-partial-panel end edges 60*e* repsectively, and longitudinal opposite rear-partial-panel bottom and top edges 60*b* and 60*t* respectively; a rectangular top-wall lid panel 62 defined by the rear-wall score line 48*r*, a longitudinal top-wall-lid score line 62*t*, and transverse opposite end edges 62*e*; a substantially rectangular top-wall tucker panel 64 defined by the top-wall-lid score line 62*t*, a longitudinal top-wall-tucker score line 64*t*, and transverse opposite end edges 64*e*; and a top-wall tucker-flap panel 66 defined by the top-wall-tucker score line 64*t*, a longitudinal top-wall-tucker edge 66*t*, and opposite end edges 66*e*.

As viewed in FIG. 4, the inner-box panels just defined are folded about their score lines in an upward direction from the plane of FIG. 4, i.e., toward the viewer, to form the inner-box walls. It will be seen that the bottom-wall panel 42, as defined by front and rear score lines 42*f* and 42*r* and opposite end score lines 42*e*, forms the inner-box bottom wall 22. The front-wall outer and inner panels 44 and 46 are folded about bottom-wall-panel front score line 42*f* and front-wall score line 44*f*, respectively, into adjacent confronting relation with each other to form the inner-box front wall 24. The rear-wall panel 48 is folded about bottom-wall-panel rear score line 42*r* into spaced confronting relation with the folded front-wall inner panel 46 to form the inner-box rear wall 26. The opposite-end-wall intermediate front partial panels 58 are folded about front-wall outer-panel opposite end score lines 44*e*, respectively, into spaced confronting relation with each other. Similarly, the opposite-end-wall intermediate rear partial panels 60 are folded about rear-wall-panel opposite end score lines 48*e*, respectively, into spaced confronting relation with each other. The opposite-end-wall outer panels 50 are folded about bottom-wall-panel opposite end score lines 42*e*, respectively, into adjacent confronting relation with the folded opposite-end-wall intermediate front and rear partial panels 58 and 60. The opposite-end-wall top panels 52 are folded about opposite-end-wall outer-panel score lines 50*e*, respectively, into adjacent confronting relation with the folded opposite-end-wall intermediate front- and rear-partial-panel top edges 58*t* and 60*t*. The opposite-end-wall inner panels 54 are folded about opposite-end-wall top-panel score lines 52*e*, respectively, into adjacent confronting relation with the folded opposite-end-wall intermediate front and rear partial panels 58 and 60. The opposite-end-wall inner-panel end flaps 56 are folded about opposite-end-wall inner-panel score lines 52*e*, respectively, into adjacent confronting relation with respective opposite end portions 42*p* of bottom-wall panel 42. The opposite-end-wall outer, intermediate, inner, and top panels 50, 58/60, 54, and 52, so folded, together form respective inner-box opposite end walls 28. The top-wall lid panel 62 is folded about rear-wall score line 48*r*, the top-wall tucker panel 64 is folded about top-wall-lid score line 62*t*, and the top-wall tucker-flap panel 66 is bent about top-wall-tucker score line 64*t*, so as to place opposite end portions 62*p* of top-wall lid panel 62 into adjacent confronting relation with the folded opposite-end-wall top panels 52, respectively, and the top-wall tucker and tucker-flap panels 64 and 66 into adjacent confronting relation with the folded front-wall inner panel 46, to thereby form the inner-box top wall 30 and close the inner box.

FIGS. 5–10 illustrate a practicable sequence in which the various panels of blank 40 can be folded to form the inner box.

As previously mentioned, inner box 20 is adapted to enclose article A. As can be appreciated from viewing FIGS. 1*a* and 1*b*, the photosensitive web roll 10 with opaque wrapper 12 thereon, and with roll-supporting hub members 14 positioned so that their hub portions 16 are repsectively inserted into opposite ends of the hollow cylindrical roll core, is lowered into the opened inner box until hub-member flange portions 18 rest upon opposite-end-wall inner-panel end flaps 56. Inner box 20 is carefully dimensioned so as to receive article A snuggly therein, and thereby prevent undue relative motion therebetween during transport and handling. Following insertion of article A, the top-wall lid panel 62, tucker panel 64, and tucker-flap panel 66 are moved to their above-described closed positions to enclose the article securely within the inner box.

In FIG. 1*c* is shown a bottomless rectanguloid outer box 70 which is adapted to enclose inner box 20. The outer box has a top wall 72, front and rear walls 74 and 76 respectively, and opposite end walls 78.

Figure 11:
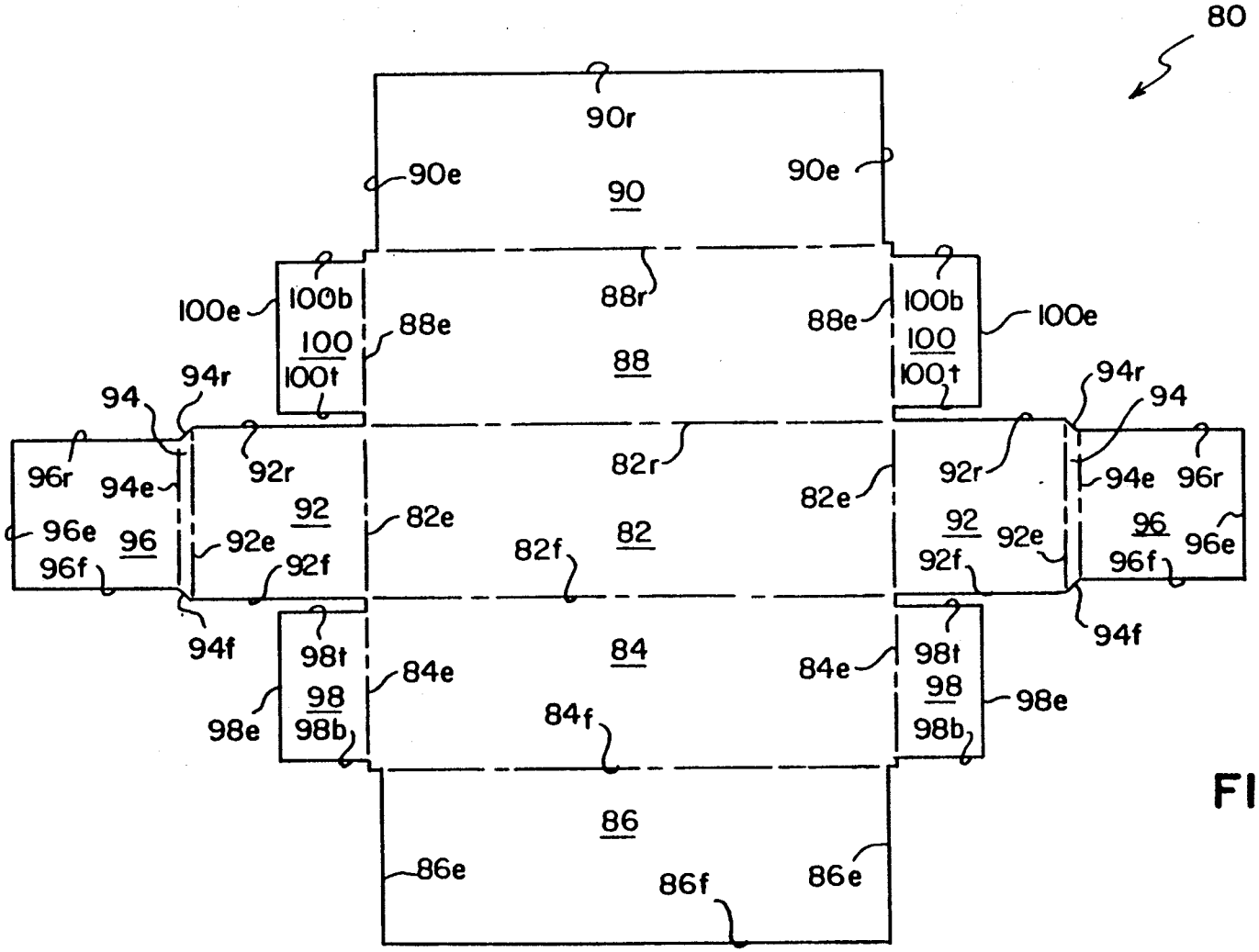
FIG. 11 is a top-plan view of a paperboard blank from which the outer-box component of the package is formed.

The outer-box walls are formed from a corrugated paperboard blank 80, shown in FIG. 11. Blank 80 includes a rectangular top-wall section 82 defined by longitudinal front and rear score lines 82*f* and 82*r* respectively and transverse opposite end score lines 82*e*; a rectangular front-wall outer section 84 defined by top-wall-section front score line 82*f*, a longitudinal front-wall score line 84*f*, and transverse opposite end score lines 84*e*; a front-wall inner section 86 defined by front-wall score line 84*f*, a longitudinal front-wall edge 86*f*, and transverse opposite end edges 86*e*; a rectangular rear-wall outer section 88 defined by top-wall-section rear score line 82*r*, a longitudinal rear-wall score line 88*r*, and transverse opposite end score lines 88*e*; a rear-wall inner section 90 defined by rear-wall score line 88*r*, a longitudinal rear-wall edge 90*r*, and transverse opposite end edges 90*e*; rectangular opposite-end-wall outer sections 92 defined by top-wall-section opposite end score lines 82*e* respectively, transverse opposite-end-wall outer-section score lines 92*e* respectively, and longitudinal opposite-end-wall outer-section front and rear edges 92*f* and 92*r* respectively; opposite-end-wall bottom sections 94 defined by opposite-end-wall outer-section score lines 92*e* respectively, transverse opposite-end-wall bottom-section score lines 94*e* respectively, and opposite-end-wall bottom-section front and rear edges 94*f* and 94*r* respectively; opposite-end-wall inner sections 96 defined by opposite-end-wall bottom-section score lines 94*e* respectively, transverse opposite-end-wall inner-section end edges 96*e* respectively, and longitudinal opposite-end-wall inner-section front and rear edges 96*f* and 96*r* respectively; opposite-end-wall intermediate front partial sections 98 defined by front-wall outer-section opposite end score lines 84*e* respectively, transverse opposite front-partial-section end edges 98*e* respectively, and longitudinal opposite front-partial-section top and bottom edges 98*t* and 98*b* respectively; opposite-end-wall intermediate rear partial sections 100 defined by rear-wall outer-section opposite end score lines 88*e* respectively, transverse opposite rear-partial-section end edges 100*e* respectively, and longitudinal opposite rear-partial-section top and bottom edges 100*t* and 100*b* respectively.

As viewed in FIG. 11, in contradistinction to the folding of blank 40 as described above with reference to FIG. 4, blank 80 is folded downwardly from the plane of FIG. 11, i.e., away from the viewer, to form the outer-box walls. Thus the top-wall section 82, as defined by front and rear score lines 82*f* and 82*r* and opposite end score lines 82*e*, forms the outer-box top wall 72. The front-wall outer and inner sections 84 and 86 are folded about top-wall-section front score line 82*f* and front-wall score line 84*f*, respectively, into adjacent confronting relation with each other to form the outer-box front wall 74. Similarly, the rear-wall outer and inner sections 88 and 90 are folded about top-wall-section rear score line 82*r* and rear-wall score line 88*r*, respectively, into adjacent confronting relation with each other to form the outer-box rear wall 76 in spaced confronting relation with the outer-box front wall 74. The opposite-end-wall intermediate front partial sections 98 are folded about front-wall outer-section opposite end score lines 84*e*, respectively, into spaced confronting relation with each other. Similarly, the opposite-end-wall intermediate rear partial sections 100 are folded about rear-wall outer-section opposite end score lines 88*e*, respectively, into spaced confronting relation with each other. The opposite-end-wall outer sections 92 are folded about top-wall-section opposite end score lines 82*e*, respectively, into adjacent confronting relation with the folded opposite-end-wall intermediate front and rear partial sections 98 and 100. The opposite-end-wall bottom sections 94 are folded about opposite-end-wall outer-section score lines 92*e*, respectively, into adjacent confronting relation with the folded opposite-end-wall intermediate front- and rear-partial-section bottom edges 98*b* and 100*b*. The opposite-end-wall inner sections 96 are folded about opposite-end-wall bottom-section score lines 94*e*, respectively, into adjacent confronting relation with the folded opposite-end-wall intermediate front and rear partial sections 98 and 100. The opposite-end-wall outer, intermediate, inner, and bottom sections 92, 98/100, 96, and 94, so folded, together form respective outer-box opposite end walls 78.

FIGS. 12–17 illustrate a practicable sequence in which the various sections of blank 80 can be folded upwardly from the plane of FIG. 12 to form the outer box in an upside-down orientation, with its top wall 72 facing downward as shown most clearly in FIG. 17.

As will be appreciated upon viewing FIGS. 1*a*, 1*b*, and 1*c* together, the inner and outer boxes 20 and 70 are configured and dimensioned so that, when inner box 20 is closed with its top wall 30 facing upward, and outer box 70 is superposed thereover with its top wall 72 also facing upward, the outer box is slidable downward in telescoping fashion closely around the inner box, with the front, rear, and opposite end walls of both boxes disposed in corresponding adjacent confronting relation to one another, to thereby form the desired light-tight package for securely containing light-sensitive article A when enclosed within the inner box.

According to the preferred embodiment of this invention, and as illustrated in FIGS. 1*b* and 2–4, the inner-box opposite-end-wall inner panels 54 include means adjacent to opposite-end-wall top panels 52, respectively, for receiving top-wall tucker-panel opposite end edges 64*e*, respectively, when the various inner-box wall panels are folded as described and top-wall tucker and tucker-flap panels 64 and 66 are moved into their adjacent confronting relation with front-wall inner panel 46 to close the inner box. Such receiving means includes a recess or cutout 54*c* in the front edge 54*f* of each inner panel 54, that extends from the adjacent top panel 52 toward the inner-panel score line 54*e*. Recess 54*c* and an adjacent end portion 46*p* of front-wall inner panel 46 together define a slot s at each front corner of inner box 20 for receiving the corresponding tucker-panel end edge 64*e*.

Also in accordance with the preferred embodiment, inner box 20 includes means for maintaining the folded front-wall outer and inner panels 44 and 46 in their adjacent confronting relation with each other; means for maintaining the folded opposite-end-wall outer panels 50 in their adjacent confronting relations with the folded opposite-end-wall intermediate front and rear partial panels 58 and 60; and means for maintaining the folded opposite-end-wall inner panels 54 in their adjacent confronting relations with the folded opposite-end-wall intermediate front and rear partial panels 58 and 60. Similarly, outer box 70 includes means for maintaining the folded front-wall outer and inner sections 84 and 86 in their adjacent confronting relation with each other; means for maintaining the folded rear-wall outer and inner sections 88 and 90 in their adjacent confronting relation with each other; means for maintaining the folded opposite-end-wall outer sections 92 in their adjacent confronting relations with the folded opposite-end-wall intermediate front and rear partial sections 98 and 100; and means for maintaining the folded opposite-end-wall inner sections 96 in their adjacent confronting relations with the folded opposite-end-wall intermediate front and rear partial sections 98 and 100. In the preferred embodiment, such maintaining means for both the inner and outer boxes is conveniently provided by adhesive material disposed between the interfacing surfaces of those panels and sections that have been folded as described into adjacent confronting relationships. The adhesive material so disposed may comprise any commonly used case-sealing hot-melt glue applied to either or both of the interfacing surfaces involved.

The present invention has been found to be especially beneficial in providing light-tight packages for relatively large photosensitive web rolls. For example, such packages containing rolls of photosensitive sheet film 200 feet long and 6 feet wide have been found to be sufficiently light-tight during exhaustive shipping and handling tests in ambient light to prevent fogging of the film with no opaque wrapper around it. Moreover, such packages have proven to be durable, and thus capable of maintaining their light-tightness, after repeated openings and closings without an opaque wrapper. Users of such photosensitive material provided in large web-rolls have long sought a durable light-tight storage medium that would obviate reapplying the factory-supplied opaque wrapper after the first opening. That long-sought, but hitherto-unresolved, need for such a storage medium has now been successfully met by this invention.

While the present invention has been described in detail with particular reference to its preferred embodiment as illustrated herein, it should be understood that variations and modifications thereof can be effected within the spirit and scope of the invention.

What is claimed is:

1. A light-tight package for securely containing a light-sensitive article, said package comprising:

a closable and openable rectanguloid inner box adapted to enclose the light-sensitive article, said inner box having a bottom wall, front and rear walls, opposite end walls, and, when closed, a top wall, said inner-box walls being formed from a first sheet of corrugated paperboard including:

a rectangular bottom-wall panel defined by longitudinal front and rear score lines and transverse opposite end score lines;

a rectangular front-wall outer panel defined by said bottom-wall-panel front score line, a longitudinal front-wall score line, and transverse opposite end score lines;

a front-wall inner panel defined by said front-wall score line, a longitudinal front-wall edge, and transverse opposite end edges;

a rectangular rear-wall panel defined by said bottom-wall-panel rear score line, a longitudinal rear-wall score line, and transverse opposite end score lines;

rectangular opposite-end-wall outer panels defined by said bottom-wall-panel opposite end score lines respectively, transverse opposite-end-wall outer-panel score lines respectively, and longitudinal opposite-end-wall outer-panel front and rear edges;

opposite-end-wall top panels defined by said opposite-end-wall outer-panel score lines respectively, transverse opposite-end-wall top-panel score lines respectively, and opposite-end-wall top-panel front and rear edges;

opposite-end-wall inner panels defined by said opposite-end-wall top-panel score lines respectively, transverse opposite-end-wall inner-panel score lines respectively, and longitudinal opposite-end-wall inner-panel front and rear edges;

opposite-end-wall inner-panel end flaps defined by said opposite-end-wall inner-panel score lines respectively, transverse opposite end-flap end edges respectively, and substantially longitudinal opposite end-flap front and rear edges;

opposite-end-wall intermediate front partial panels defined by said front-wall outer-panel opposite end score lines respectively, transverse opposite front-partial-panel end edges respectively, and longitudinal opposite front-partial-panel bottom and top edges;

opposite-end-wall intermediate rear partial panels defined by said rear-wall-panel opposite end score lines respectively, transverse opposite rear-partial-panel end edges respectively, and longitudinal opposite rear-partial-panel bottom and top edges;

a rectangular top-wall lid panel defined by said rear-wall score line, a longitudinal top-wall-lid score line, and transverse opposite end edges;

a substantially rectangular top-wall tucker panel defined by said top-wall-lid score line, a longitudinal top-wall-tucker score line, and transverse opposite end edges; and a top-wall tucker-flap panel defined by said top-wall-tucker score line, a longitudinal top-wall-tucker edge, and opposite end edges;

said bottom-wall panel as defined by said front and rear score lines and said opposite end score lines thereof forming said inner-box bottom wall;

said front-wall outer and inner panels being folded about said bottom-wall-panel front score line and said front-wall score line, respectively, into adjacent confronting relation with each other to form said inner-box front wall;

said rear-wall panel being folded about said bottom-wall-panel rear score line into spaced confronting relation with said folded front-wall inner panel to form said inner-box rear wall;

said opposite-end-wall intermediate front partial panels being folded about said front-wall outer-panel opposite end score lines, respectively, into spaced confronting relation with each other;

said opposite-end-wall intermediate rear partial panels being folded about said rear-wall-panel opposite end score lines, respectively, into spaced confronting relation with each other;

said opposite-end-wall outer panels being folded about said bottom-wall-panel opposite end score lines, respectively, into adjacent confronting relation with said folded opposite-end-wall intermediate front and rear partial panels;

said opposite-end-wall top panels being folded about said opposite-end-wall outer-panel score lines, respectively, into adjacent confronting relation with said folded opposite-end-wall intermediate front- and rear-partial-panel top edges;

said opposite-end-wall inner panels being folded about said opposite-end-wall top-panel score lines, respectively, into adjacent confronting relation with said folded opposite-end-wall intermediate front and rear partial panels;

said opposite-end-wall inner-panel end flaps being folded about said opposite-end-wall inner-panel score lines, respectively, into adjacent confronting relation with opposite end portions of said bottom-wall panel respectively;

said opposite-end-wall outer, intermediate, inner, and top panels, so folded, together forming said inner-box opposite end walls respectively; and said top-wall lid panel being folded about said rear-wall score line, said top-wall tucker panel being folded about said top-wall-lid score line, and said top-wall tucker-flap panel being bent about said top-wall-tucker score line, so as to place opposite end portions of said top-wall lid panel in adjacent confronting relation with said folded opposite-end-wall top panels, respectively, and said top-wall tucker and tucker-flap panels in adjacent confronting relation with said folded front-wall inner panel, to thereby form said inner-box top wall and close said inner box; and a bottomless rectanguloid outer box adapted to enclose the inner box, said outer box having a top wall, front and rear walls, and opposite end walls, said outer-box walls being formed from a second sheet of corrugated paperboard including:

a rectangular top-wall section defined by longitudinal front and rear score lines and transverse opposite end score lines;

a rectangular front-wall outer section defined by said top-wall-section front score line, a longitudinal front-wall score line, and transverse opposite end score lines;

a front-wall inner section defined by said front-wall score line, a longitudinal front-wall edge, and transverse opposite end edges;

a rectangular rear-wall outer section defined by said top-wall-section rear score line, a longitudinal rear-wall score line, and transverse opposite end score lines;

a rear-wall inner section defined by said rear-wall score line, a longitudinal rear-wall edge, and transverse opposite end edges;

rectangular opposite-end-wall outer sections defined by said top-wall-section opposite end score lines respectively, transverse opposite-end-wall outer-section score lines respectively, and longitudinal opposite-end-wall outer-section front and rear edges;

opposite-end-wall bottom sections defined by said opposite-end-wall outer-section score lines respectively, transverse opposite-end-wall bottom-section score lines respectively, and opposite-end-wall bottom-section front and rear edges;

opposite-end-wall inner sections defined by said opposite-end-wall bottom-section score lines respectively, transverse opposite-end-wall inner-section end edges respectively, and longitudinal opposite-end-wall inner-section front and rear edges;

opposite-end-wall intermediate front partial sections defined by said front-wall outer-section opposite end score lines respectively, transverse opposite front-partial-section end edges respectively, and longitudinal opposite front-partial-section top and bottom edges;

opposite-end-wall intermediate rear partial sections defined by said rear-wall outer-section opposite end score lines respectively, transverse opposite rear-partial-section end edges respectively, and longitudinal opposite rear-partial-section top and bottom edges;

said top-wall section as defined by said front and rear score lines and said opposite end score lines thereof forming said outer-box top wall;

said front-wall outer and inner sections being folded about said top-wall-section front score line and said front-wall score line, respectively, into adjacent confronting relation with each other to form said outer-box front wall;

said rear-wall outer and inner sections being folded about said top-wall-section rear score line and said rear-wall score line, respectively, into adjacent confronting relation with each other to form said outer-box rear wall in spaced confronting relation with said outer-box front wall;

said opposite-end-wall intermediate front partial sections being folded about said front-wall outer-section opposite end score lines, respectively, into spaced confronting relation with each other;

said opposite-end-wall intermediate rear partial sections being folded about said rear-wall outer-section opposite end score lines, respectively, into spaced confronting relation with each other;

said opposite-end-wall outer sections being folded about said top-wall-section opposite end score lines, respectively, into adjacent confronting relation with said folded opposite-end-wall intermediate front and rear partial sections;

said opposite-end-wall bottom sections being folded about said opposite-end-wall outer-section score lines, respectively, into adjacent confronting relation with said folded opposite-end-wall intermediate front- and rear-partial-section bottom edges; and said opposite-end-wall inner sections being folded about said opposite-end-wall bottom-section score lines, respectively, into adjacent confronting relation with said folded opposite-end-wall intermediate front and rear partial sections;

said opposite-end-wall outer, intermediate, inner, and bottom sections, so folded, together forming said outer-box opposite end walls respectively;

said inner and outer boxes being configured and dimensioned so that, when said inner box is closed with its top wall facing upward, and said outer box is superposed thereover with its top wall facing upward, said outer box is slidable downward in telescoping fashion closely around said inner box, with said front and rear walls and said opposite end walls of said boxes disposed in corresponding adjacent confronting relation to one another, thereby forming said light-tight package for securely containing the light-sensitive article when enclosed within said inner box.

2. A light-tight package as claimed in claim 1 wherein said inner-box opposite-end-wall inner panels include means adjacent to said opposite-end-wall top panels, respectively, for receiving said top-wall tucker-panel opposite end edges, respectively, when said inner-box wall panels are folded to form said inner box and said top-wall tucker and tucker-flap panels are moved into said adjacent confronting relation with said front-wall inner panel to close said inner box.

3. A light-tight package as claimed in claim 2 wherein said receiving means includes a recess in the front edge of each inner panel extending from the adjacent top panel toward the inner-panel score line, said recess and an adjacent end portion of said front-wall inner panel together defining a slot for receiving one of said tucker-panel end edges.

4. A light-tight package as claimed in claim 1 wherein said inner box includes:

first means for maintaining said folded front-wall outer and inner panels in said adjacent confronting relation with each other;

second means for maintaining said folded opposite-end-wall outer panels in said adjacent confronting relation with said folded opposite-end-wall intermediate front and rear partial panels; and third means for maintaining said folded opposite-end-wall inner panels in said adjacent confronting relation with said folded opposite-end-wall intermediate front and rear partial panels;

and wherein said outer box includes:

fourth means for maintaining said folded front-wall outer and inner sections in said adjacent confronting relation with each other;

fifth means for maintaining said folded rear-wall outer and inner sections in said adjacent confronting relation with each other;

sixth means for maintaining said folded opposite-end-wall outer sections in said adjacent confronting relation with said folded opposite-end-wall intermediate front and rear partial sections; and seventh means for maintaining said folded opposite-end-wall inner sections in said adjacent confronting relation with said folded opposite-end-wall intermediate front and rear partial sections.

5. A light-tight package as claimed in claim 4 wherein said inner-box first, second, and third maintaining means include adhesive material disposed between interfacing surfaces of said panels folded into said adjacent confronting relationships; and wherein said outer-box fourth, fifth, sixth, and seventh maintaining means include adhesive material disposed between interfacing surfaces of said sections folded into said adjacent confronting relationships.

* * * * *

UNITED STATES PATENT AND TRADEMARK OFFICE

CERTIFICATE OF CORRECTION

PATENT NO. : 5,022,524

DATED : June 11, 1991

INVENTOR : Ralph E. Grady

It is certified that error appears in the above-identified patent and that said Letters Patent is hereby corrected as shown below:

On Title page, in the ABSTRACT, line 12 thereof, after "outer", insert the words -- boxes are shaped and sized so that, when the inner --.

In Col. 7, line 57, change "52e" to -- 54e --.

Signed and Sealed this

Twenty-fourth Day of November, 1992

*Attest:*

DOUGLAS B. COMER

*Attesting Officer*

*Acting Commissioner of Patents and Trademarks*